United States Patent [19]

Harper et al.

[11] Patent Number: 4,917,195

[45] Date of Patent: Apr. 17, 1990

[54] QUICK LATCH MUD MAT APPARATUS

[75] Inventors: Gary L. Harper, Houma; Samuel D. Brady, IV; Robert M. Shivers, III, both of Patterson, all of La.

[73] Assignee: Texaco Inc., White Plains, N.Y.

[21] Appl. No.: 269,342

[22] Filed: Nov. 3, 1988

[51] Int. Cl.[4] ..... E21B 7/128

[52] U.S. Cl. ..... 175/7; 166/339; 166/340; 166/365

[58] Field of Search ..... 166/348, 349, 342, 339, 166/341, 366, 368, 75.1; 175/7; 405/227, 224, 198; 285/91, 33, 140, 143

[56] References Cited

U.S. PATENT DOCUMENTS

| | | | |
|---|---|---|---|
| 1,132,123 | 3/1915 | Royer et al. | 285/91 |
| 3,080,921 | 3/1963 | Lacy | 166/368 |
| 3,519,071 | 7/1970 | Word, Jr. | 175/7 X |
| 3,559,754 | 2/1971 | Morrill | 175/7 |
| 4,216,835 | 8/1980 | Nelson | 175/7 X |
| 4,460,047 | 7/1984 | Pokladnik | 166/341 |
| 4,553,600 | 11/1985 | Vigouroux et al. | 166/339 X |
| 4,611,661 | 9/1986 | Hed et al. | 166/339 |

*Primary Examiner*—Hoang C. Dang

*Attorney, Agent, or Firm*—Robert A. Kulason; James J. O'Loughlin; Robert B. Burns

[57] ABSTRACT

A subsea drilling drive pipe apparatus for drilling offshore wells from a floating vessel into the ocean floor. An elongated drilling drive pipe including a plurality of locking pads which are circumferentially positioned about the drive pipe periphery. A foundation structure is removably engageable with the elongated drive pipe by one or more locking pins which detachably engage the drive pipe thereby permitting the assembled members to be lowered as a unit to the ocean floor in contemplation of a subsea well drilling operation.

5 Claims, 3 Drawing Sheets

QUICK LATCH MUD MAT APPARATUS

BACKGROUND OF THE INVENTION

The development and subsequent production of hydrocarbon fluids from offshore reservoirs and fields normally necessitates the drilling of one or more wells into the ocean floor. Frequently, the water depth at the well site is such at these locations that it becomes necessary to drill from a floating vessel which is adapted to the purpose. These offshore working sites often embody different and varied floor compositions into which the wells are formed. For example, the sea floor can be unconsolidated and give minimal support. However, it can be a consolidated composition and be very supportive of well equipment.

To make an offshore well operable, a drive pipe approximately thirty inches in diameter is jetted into the sea floor and fastened in place. This procedure is found to be most feasible where the sea floor permits.

As a matter of practicality, this drive pipe is frequently incapable of supporting the necessary drilling equipment and accessories. Such equipment includes blowout preventers, flow control means, well heads, and remotely operable controls. In brief, the sea floor positioned equipment can be both bulky and heavy.

To assure an adequate support base for the required operating equipment, the drive pipe is provided with an artificial foundation or support base. In instances where the ocean floor is particularly soft, the foundation or support base will take the form of what is commonly referred to in the drilling industry as a mud mat. The latter comprises basically a large plate which rests on the ocean floor and which functions to distribute the weight of the supported equipment over a large area.

A desirable expedient practiced by the industry when drilling an offshore well from a vessel, is to utilize guidelines which extend between the vessel and the subsea well head. The lines take the form of steel cables, normally four, which attach to both the vessel and to the foundation structure. This arrangement permits equipment to be readily lowered from the surface, guided along the lines, and thus to be properly aligned for engagement with equipment at the ocean floor.

It is the usual practice when lowering this form of well apparatus to the ocean floor, to weld first the artificial foundation or support base to the drive pipe. The entire assembly is then jetted into the ocean floor. With the guidelines attached to the foundation member, and extending to the surface, the system is operable to accurately and safely guide a drilling guide base or blowout preventers to communicably engage the conductor.

The common practice of welding the foundation member to the drive pipe at the drilling site, constitutes a relatively expensive operation. This is due to the necessary positioning of the two components, and the necessary welding thereof to form them into a unit.

It can be appreciated that in any such offshore operations, it is desirable to salvage and retain subsea equipment for further use after it has exhausted its use at a particular drill site. However, federal or state regulations usually require that when a subsea well is no longer usable, its use be terminated by severing the conductor below the sea floor a sufficient distance to preclude its being a navigational hazard. However, with the foundation member firmly welded to the drive pipe, it is difficult to salvage either member without inflicting damage that might render them unusable or unsafe.

STATEMENT OF THE INVENTION

Toward overcoming these operational problems endemic to an offshore well drilling operation, the presently disclosed apparatus includes an improved system. In brief, the drive pipe and foundation member are detachably coupled or engaged at the surface prior to lowering to the sea floor. Thus, while the apparatus is at the surface on a drilling vessel prior to being lowered, the drive pipe which has been provided with a set of locking pads, is assembled into the foundation member.

With the two members in proper alignment, one or more prepositioned locking pins are loosened from the foundation member. They are then driven into a pin receptacle in the drive pipe locking pad. The locking pins are thereafter rigidly fixed in place and the composite unit is lowered to its position on the sea floor.

When at a future date it becomes necessary to discontinue operation at the well, an opposite routine is followed. The foundation/drive pipe assembly is severed from the well 20 to 25 feet below the sea floor with a mechanical cutter or explosive charge. With the two units thus severed, the composite assembly can be raised to the drill vessel.

The foundation member can then be readily disconnected from the drive pipe by retracting the locking pin or pins from their locking position and into the withdrawn or non-operating mode. The use of pins or similar means to couple and uncouple a conductor pipe to a foundation member embodies several advantages. First, it saves valuable drill vessel time when compared to welding and subsequent cutting. Further, it maintains the foundation member in a reusable and safe condition.

It is therefore an object of the invention to provide a novel subsea well forming apparatus adapted to be lowered from a drilling vessel to the ocean floor.

A further object is to provide a drilling drive pipe which, when combined with a foundation member, can be lowered as a unit to the ocean floor toward the formation of a well.

A still further object is to provide a well forming apparatus of the type contemplated wherein a drive pipe is detachably connected to an ocean floor foundation by one or more locking pins which are removable to permit the subsequent uncoupling of the two members.

DESCRIPTION OF THE DRAWINGS

Referring to FIG. 1, a system of the type generally contemplated is shown wherein a drilling vessel 10 is positioned at the surface of a body of water 11.

Figure 1:
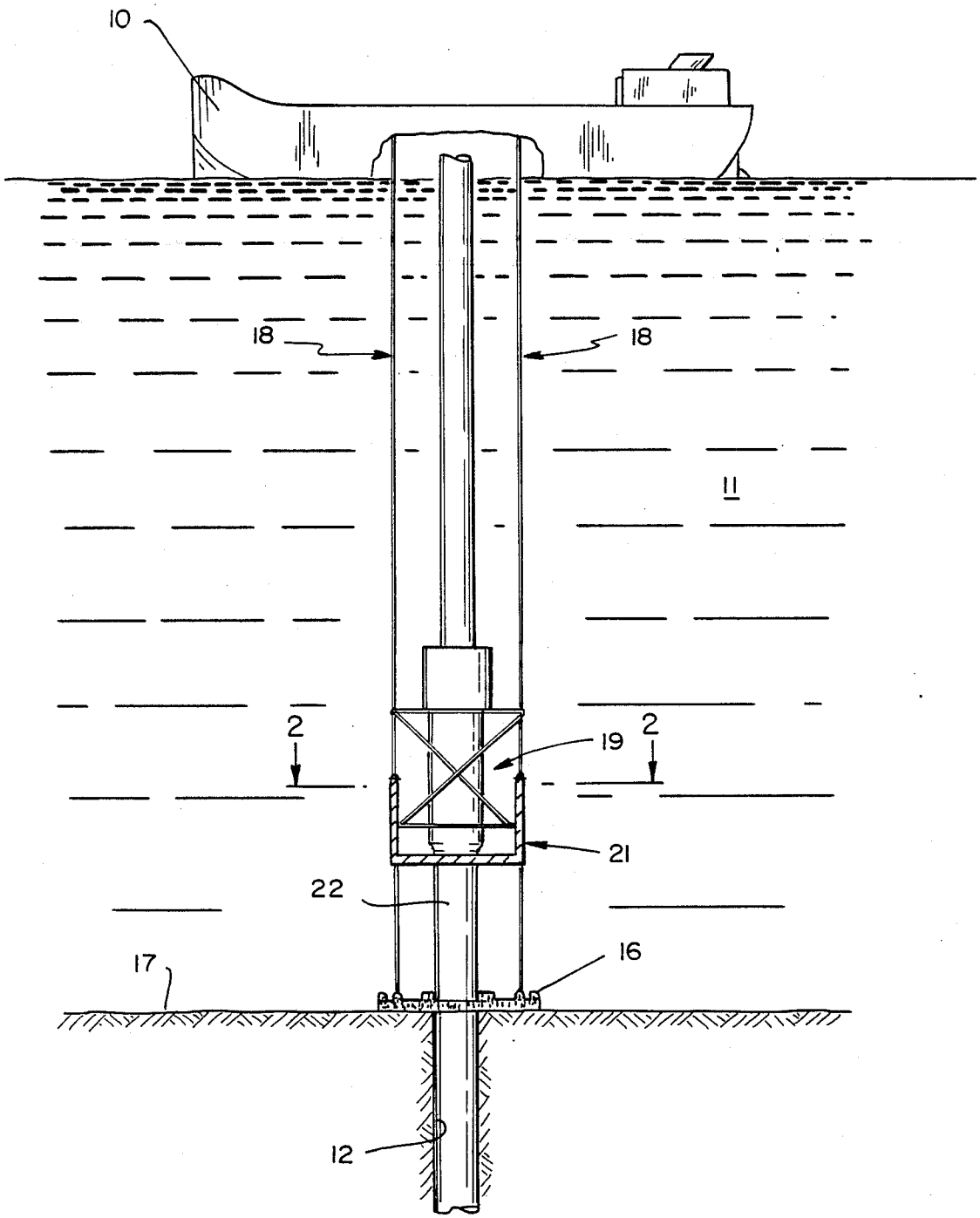
FIG. 1 is an environmental view of the present invention at a submerged, offshore well site.

A drive pipe 22 is provided with a foundation member 16 which functions as a mud mat as the unit is lowered to the ocean floor 17 and jetted into 150–300 feet penetration. Foundation member 16 includes means for engaging a plurality of flexible cables 18 which extend to the ocean's surface. The cables pass through a drilling guidebase 21 and are attached to drilling vessel 10 by motion compensators or other suitable means to account for the vessel's wave induced movement. A conductor hole 12 is then drilled several hundred or a few thousand feet into the sea floor 14. Conductor casing is then run into the hole to stabilize the latter and fasten in place by cementing.

Operationally, necessary drilling equipment such as blowout preventers 19 are prepositioned onto the guidelines 18 and lowered onto the drilling guidebase 21. At the latter where they can be coupled to the conductor casing.

Figure 3:
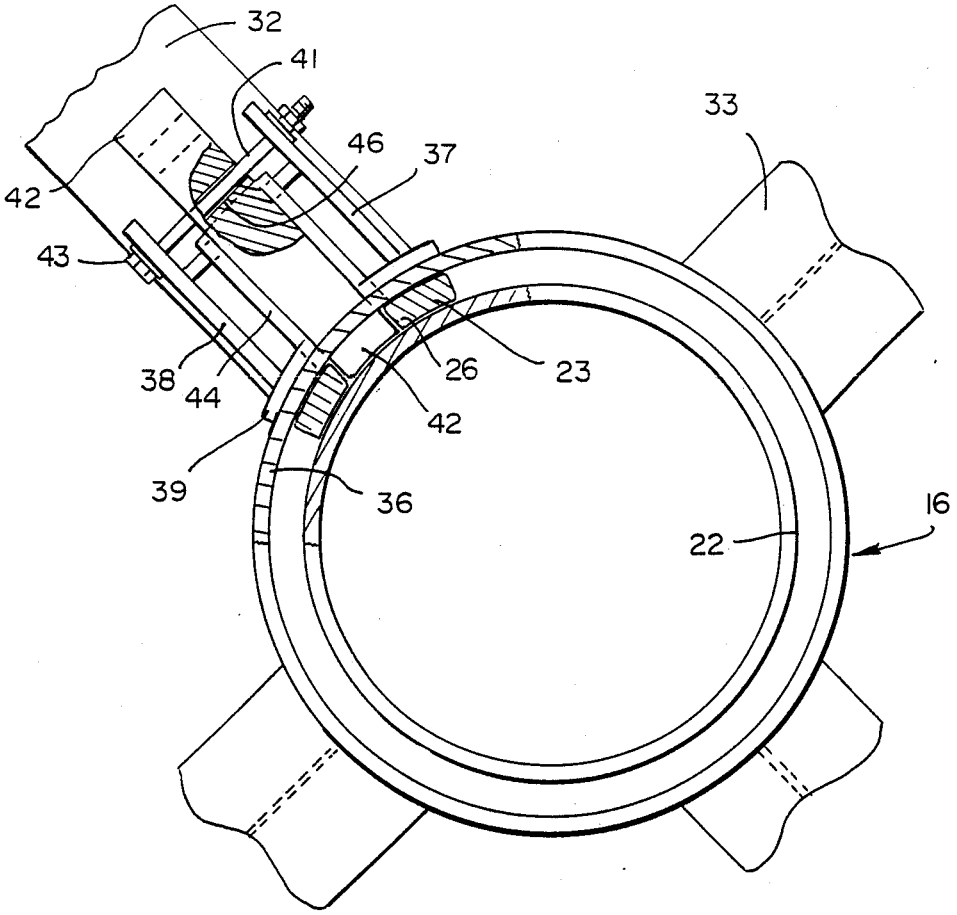
FIG. 3 is a segmentary view on an enlarged scale of FIG. 2.
Figure 4:
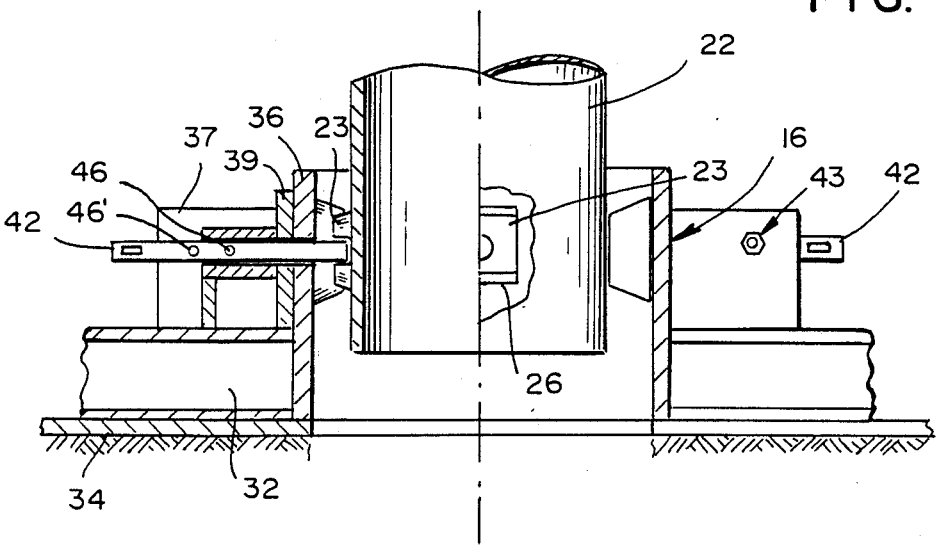
FIG. 4 is a cross-sectional view taken along line 4—4 in FIG. 3.

Referring to FIGS. 3 and 4, drive pipe 22 is of the type contemplated and normally utilized for this type of well forming operation. Physically it is comprised of a thirty inch diameter steel pipe having a sufficient wall thickness to accommodate subsequently applied loads. The upper portion of drive pipe 22 is provided on its outer surface with at least one and preferably with a plurality of bearing or locking pads 23. These pads are welded to the drive pipe's peripheral surface.

When a plurality of the locking pads 23 are utilized, they are peripherally equispaced about the drive pipe's upper end to facilitate registry of subsequently applied locking pins 42. Each locking pad 23 is curved to conform with the drive pipe's surface, and is provided with an opening 26. Said opening 26 constitutes a pin receptacle into which locking pins 42 are subsequently inserted when drive pipe 22 is fixed to the foundation member 16. Locking pads 23 are of sufficient thickness to assure their structural feasibility and to provide the locking pin 42 with a bearing surface to withstand the subsequently applied weight.

Figure 2:
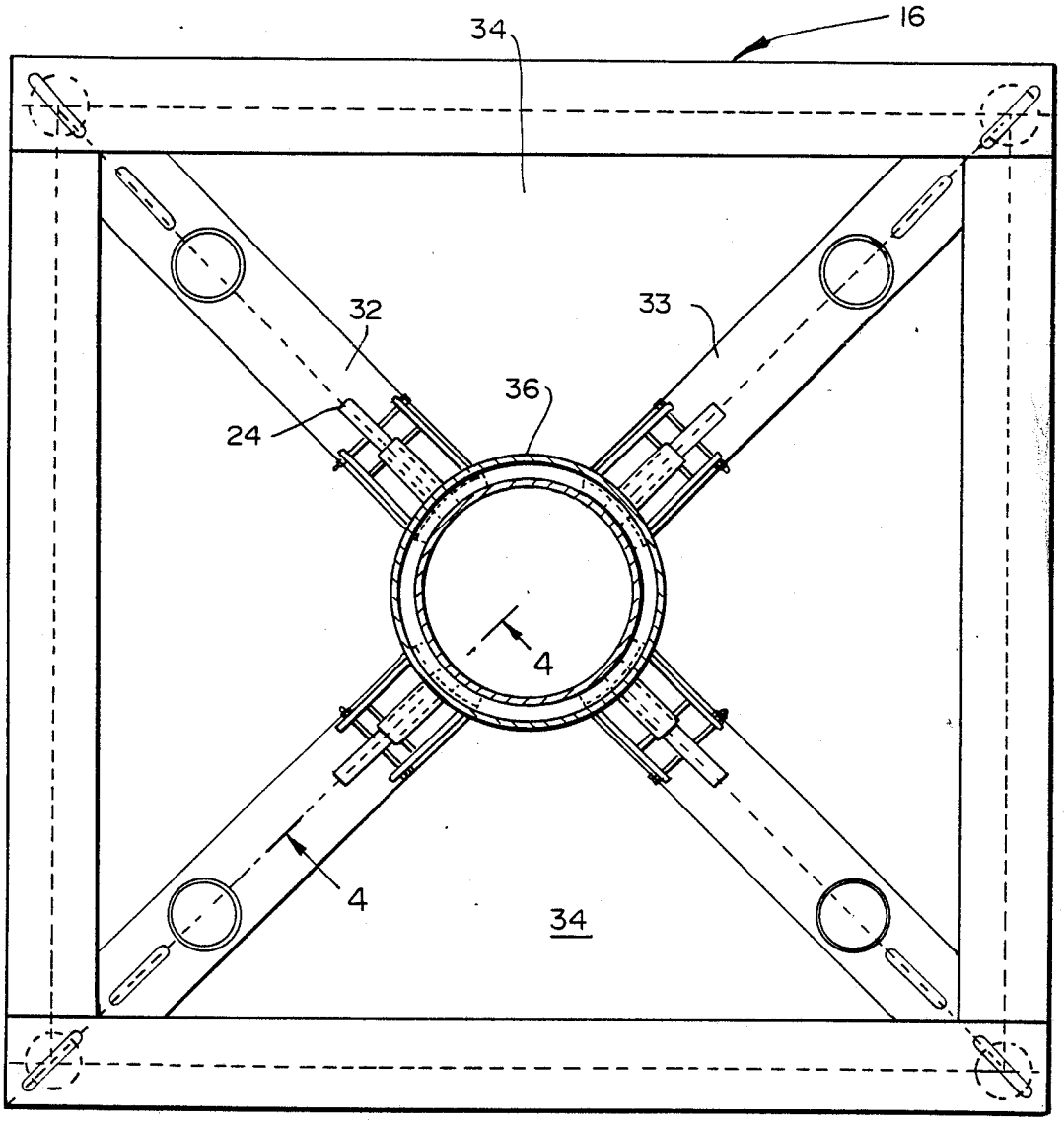
FIG. 2 is a cross-sectional view on an enlarged scale, taken along line 2—2 in FIG. 1.

Foundation member 16 as shown in FIG. 2, is comprised primarily of a series of base members such as I-beams or the like. Said members are positioned and welded into a generally square formation to form a support structure. A plurality of transverse braces 32 and 33 extend inwardly from the respective corners of the support structure toward the center thereof.

A base plate 34 fastened to the underside of the respective base members serves as a mud mat or artificial foundation when it rests on ocean floor 17. As noted herein, base plate 34 is dimensioned to distribute the expected load onto an exterior area of the ocean floor about the well itself.

As seen, in FIG. 3, an upright column 36 depends from foundation 16 in a direction substantially normal to the base plate 34. Said column 36 is welded to the inner ends of the respective cross braces 32 and 33.

Referring to FIGS. 3 and 4, in the illustrated arrangement, foundation member 16 is provided with a plurality of, and preferably with four locking pin assemblies each of which is positioned adjacent to column 36, and on one or more of the cross members such as 32. Each locking pin assembly is comprised of a pair of spaced apart side plates 37 and 38 which are welded to the upper surface of cross brace 32. Plates 37 and 38 in turn are end connected to a curved bracket 39. The latter is fastened, preferably by welding, to the exterior surface of the column 36.

A tubular guide sleeve 44 is fastened to bracket 39, and extends outwardly therefrom between the respective side plates 37 and 38. A locking pin 42 is slidably positioned in each sleeve 44.

In the retracted position, the engaging head of the locking pin 42 is withdrawn into the sleeve 44. It is removably fixed in the retracted position by a locking bolt 43 which passes through aligned openings the respective end plates 37 and 38, and through a first transverse hole 46 in the locking pin body.

When locking pin 42 is advanced to the locking position it will register in the pin receptacle 26 formed in the locking pad 23. To achieve this movement, locking bolt 43 is first withdrawn from the transverse opening or openings 46, thereby permitting the pin to be longitudinally adjusted through sleeve 44 to its locking position. With the pin head registered in the pin, receptacle 26 locking bolt 43 can be replaced into opening 46' thereby firmly positioning locking pin 42 with respect to the locking pad 23. When so positioned, drive pipe 22 is firmly located with respect to foundation member 16.

While the present embodiment illustrates four locking stations which allow the individual members to be connected at four individual spaced apart locations, a lesser or greater number of locking points and/or cross braces can be utilized depending on the circumstances.

Operationally, when foundation member 16 and drive pipe 22 are individually connected on a drilling vessel, they can be readily aligned by prepositioning the drive pipe 22 into guide column 36. This step necessitates the alignment of the various locking pads 23 with the corresponding locking pins 42, the latter being held in their retracted position.

When the respective members are properly aligned, their locking pins 42 are released by withdrawing the bolt 43, thereby permitting the pins to be advanced. The pin head 42' will then register in pin receptacle 26. The locking bolt 43 is now reinserted into the second locating hole 46' fastening the pin in place. The foundation member 16 and the drive pipe 22 can now be handled as a unit. When so coupled, the combination can be lowered from the drilling vessel 10 to the ocean floor where the drive pipe is jetted to sufficient penetration so that the foundation 16 comes to rest on the sea floor.

It is understood that although modifications and variations of the invention can be made without departing from the spirit and scope thereof, only such limitations should be imposed as are indicated in the appended claims.

We claim:

1. In combination with a submergible foundation structure having a base plate for resting on the floor of a body of water, and having a column upstanding from said base plate for registering an elongated conductor, a locking mechanism on the foundation structure being operable to releasably support said elongated conductor, said locking mechanism comprising:

a locking pin sleeve support means mounted to said column and including spaced apart plates and a bracket, said spaced apart plates having aligned first opening means therein, a locking pin sleeve positioned between said spaced apart plates and having one end engaging said bracket, a locking pin slidably mounted in said sleeve for movement between an advanced position in which said locking pin engages the conductor and a retracted position in which said locking pin disengages the conductor, and a locking bolt disposed in said aligned first opening means of said respective spaced apart plates to releasably engage said locking pin when the latter has been adjusted to a desired position.

2. In the apparatus as defined in claim 1 wherein said elongated conductor includes:

a plurality of locking pads equispaced about the conductor periphery to be engaged by said locking pin when the latter is in the advanced position and locked by said locking bolt.

3. In the apparatus as defined in claim 1, wherein said locking pin:

a positioning bolt extending transversely of the locking pin and being operably positioned to engage the locking pin to maintain the latter in a particular position.

4. In the apparatus as defined in claim 1 wherein said locking pin includes at least one means forming a transfer opening positioned to be in alignment with said first opening means in said spaced apart plates when said locking pin is adjusted to the advance position in engagement with said column.

5. In the apparatus as defined in claim 4 wherein said locking pin includes a second transfer opening spaced longitudinally from said first transfer opening to position said locking bolt when the latter is adjusted to its retracted position.

* * * * *